343-872 SR
6/30/87 OR 4,677,443

United States Patent [19]
Koetje et al.

[11] Patent Number: 4,677,443
[45] Date of Patent: Jun. 30, 1987

[54] BROADBAND HIGH TEMPERATURE RADOME APPARATUS

[75] Inventors: Edward L. Koetje; Frederick H. Simpson; James F. Schorsch, all of Seattle, Wash.

[73] Assignee: The Boeing Company, Seattle, Wash.

[21] Appl. No.: 230,372

[22] Filed: Feb. 2, 1981

Related U.S. Application Data

[63] Continuation-in-part of Ser. No. 6,711, Jan. 26, 1979, abandoned.

[51] Int. Cl.[4] ..... H01Q 1/42
[52] U.S. Cl. ..... 343/872
[58] Field of Search ..... 343/872; 428/446

[56] References Cited

U.S. PATENT DOCUMENTS

| | | | |
|---|---|---|---|
| 3,292,544 | 12/1966 | Caldwell et al. | 343/872 |
| 3,386,918 | 6/1968 | Hough et al. | 343/911 R |
| 3,545,146 | 12/1970 | Kerr | 343/872 |
| 3,716,869 | 2/1973 | Gould et al. | 343/912 |
| 4,020,234 | 4/1977 | Garnder | 428/446 |
| 4,173,187 | 11/1979 | Steverding | 343/872 |
| 4,252,860 | 2/1981 | Brennan et al. | 428/446 |

OTHER PUBLICATIONS

Metzcfr; Lightweight Ceramics Seen As Ideal For Radomes; Ceramic Industry; Jun. 1957, pp. 122, 123, 125.

*Primary Examiner*—Eli Lieberman
*Attorney, Agent, or Firm*—Thomas H. Murray; Clifford A. Poff

[57] ABSTRACT

A broadband high temperature radome includes a high density outer skin layer and a low density core layer made from a ceramic material selected from the group consisting of silicon nitride and barium-aluminum silicate. Silicon nitride is sintered, reaction-sintered or chemically vapor-deposited. The outer skin has a moderate dielectric constant of about 5.0 and the core layer has a low dielectric constant of about 1.8. Both dielectric constants do not sigificantly vary at temperatures up to 1500° C. Low thermal expansion of the core and skin layers are matched by the thermal expansion of a base connector constructed in a laminated form of graphite/polyimide. The thickness of the core layer to the thickness of the skin layer is given by the ratio of about 15:1 where the skin layer thickness is about 0.030 inch. Polyimide resin is used for the high temperature adhesive to adhere the connector to the core and skin layers. The core layer is impregnated with a dielectric filler, if desired.

15 Claims, 10 Drawing Figures

INSERTION PHASE DIFFERENCE DEGREES
120
100
80
60
40
70°F ∘
650°F ×
950°F △
$F_0-4$
$F_0$
$F_0+4$
$F_0+8$
FREQUENCY

ATTENUATION - DB
2.0
1.5
1.0
0.5
0
70°F ∘
650°F ×
950°F △
$F_0-4$
$F_0$
$F_0+4$
$F_0+8$
FREQUENCY

INSERTION PHASE DIFFERENCE DEGREES
100
90
80
70
60
0
20
40
60
80
INCIDENT ANGLE - DEGREES

TRANSMISSION EFFICIENCY PERCENT
100
90
80
70
60
0
20
40
60
80
INCIDENT ANGLE - DEGREES

BROADBAND HIGH TEMPERATURE RADOME APPARATUS

CROSS-REFERENCE TO RELATED APPLICATION

This application is a continuation-in-part of application Ser. No. 6,711, filed Jan. 26, 1979, now abandoned.

BACKGROUND OF THE INVENTION

This invention relates to a broadband radome for use in a high temperature environment such as those imposed by high supersonic and hypersonic speeds by providing a radome wall utilizing one of a group of ceramic materials consisting of silicon nitride and barium-aluminum silicate to form a core layer and a skin layer. The invention further provides a high temperature adhesive and a base connector for transitional support of a ceramic radome for structural adequacy on a body of an aircraft or the like for use in a high temperature environment.

Broadband radomes for us in the high temperature environment generated by high supersonic and hypersonic speeds must possess structural adequacy to withstand severe thermal and aerodynamic loads as well as erosion effects due to rain and dust. The materials and production processes to produce radomes for such an environment must allow consistent accurate production while achieving high electrical performance with minimal error over broad bandwidths and/or large antenna scan angles. Prior attempts to provide a radome to meet the demands for such high temperature environments have not successfully solved the problems due to several shortcomings.

A solid wall ceramic radome such as employed in the Sparrow and Phoenix missiles has limited rain erosion capabilities as well as a limited bandwidth capability. The conventional A-type and C-type sandwich constructions for broadband radomes using high temperature materials have a limited structural adequacy to withstand thermal gradients because of high tensile stresses developed in the radome wall.

In U.S. Pat. No. 3,292,544 there is disclosed a radome wall consisting of thin inner and outer layers with a dielectric constant of 8–12 bonded to a thick central core with a dielectric constant of 2–5. Alumina, mullite or calcined sillimanite is used to make the walls of the radome. Such a radome is designed for use at a discrete frequency defined by controlling the inner and outer wall layer thicknesses so as not to exceed 0.06 of the full wavelength of the energy to be transmitted. The transmission of electromagnetic energy is within a relatively narrow bandwidth as compared with a bandwidth in excess of 4 octaves which can be transmitted by a radome embodying the features of the present invention. The inorganic refractory oxide ceramic materials and the three-layered construction of the radome wall provide only limited resistance to thermal gradients when compared with the radome of the present invention. This is because temperature differences between the outer and inner wall layers develop high tensile stresses in the lower temperature thin-walled layer and a high transverse tensile stress on the central core and on the bonds between the core and the inner and outer layers. However, the inorganic refractory oxide materials have only limited resistance to these tensile stresses.

The radome wall is highly susceptible to local variations in density, strength and electrical properties due to a non-uniform chemical composition of the bonded refractory because about 10% bonding materials such as clay, crystal growth inhibitors and mineralizers are admixed with the refractory oxide. Any such local variation produces a substantial variation to the electrical performance as well as variations in strength from one radome to the next. These variations bring about increased boresight error, the requirement for expensive prescription grinding of each radome and an increased rejection rate of finished radomes because of unacceptable electrical performance or low strength. The present invention eliminates dependency on bonding materials and utilizes a two-layered homogeneous ceramic material, thus avoiding the limitations of known refractory oxide materials for a radome wall.

Precision control of the inner and outer layer thicknesses is essential for a broadband application because of the relatively high dielectric constant of these radome layers. Only expensive prescription grinding of one or both of the inner and outer layers as a final step in the radome construction can be carried out to provide precise control of uniform electrical performance. In contrast to this, the present invention provides that the manufacturing tolerances are far less critical because lower dielectric constant materials are used, but without sacrificing broadband electrical performance, strength or incurring the substantial expense for prescription grinding.

A slurry or suspension of the inorganic refractory oxide is initially formed to manufacture the known radome walls. The slurry is then molded, dried and fired which causes a shrinkage of the radome of between 1.3% to about 10%–12%. The firing process increases the tendency for radome wall cracks and diminishes the ability for accurate control of critical radome dimensions. Moreover, in the manufacturing operations, organic hollow particles of a volatilizable resin are admixed with the bonding material and inorganic refractory when the slurry or suspension is formed. The use of such hollow resinous particles is necessary to vary the density of the material but is an unacceptable addition to the material used to form the radome wall of the present invention.

SUMMARY OF THE INVENTION

It is an object of the present invention to provide an improved radome apparatus embodying ceramic materials to form a radome wall to accommodate thermal gradients without developing high stresses and at the same time provide high transmission efficiency and low boresight error over broad bandwidths in the ultrahigh and superhigh frequency bands.

It is a further object of the present invention to provide an improved radome apparatus wherein ceramic materials are utilized to form a radome wall comprising a skin layer and a core layer for broadband use without sensitivity to small variations to material properties or layer thicknesses expected in production while providing protection from rain and dust erosion at high supersonic speed.

It is another object of the present invention to provide a unique, two-layered construction of a radome from certain ceramic materials selected to combine broadband electrical performance and resistance to high thermal gradients with production processes for consistent, accurate manufacturing.

More particularly, according to the present invention, there is provided a broadband high temperature radome resistant to strains induced by thermal gradients wherein the radome comprises a low density core layer and a high density outer skin layer consisting of a ceramic material selected from the group consisting of silicon nitride and barium aluminum silicate. The low density core layer has a low dielectric constant and the high density outer skin layer has a moderate dielectric constant which remain substantially unchanged at high temperatures up to 1500° F.

The present invention further provides a unique base connector constructed of a laminated high temperature-resistant material having low thermal expansion to closely match the thermal expansion of a ceramic radome, particularly a radome wall of silicon nitride or barium-aluminum silicate, and a high temperature adhesive to adhere the ceramic material of the radome to the base connector.

Furthe and preferred characteristics ot the radome of the present invention include a thickness ratio of about 15:1 between the core layer and the skin layer. The skin layer is preferably about 0.030 inch which can be judiciously varied to meet design requirements while the thickness of the core layer is far less critical and may be varied over a much broader range of thicknesses. The core layer usually has a dielectric constant of about 1.8 with a low electrical loss tangent while the skin layer has a dielectric constant of about 5.0 with a low electrical loss tangent. When silicon nitride is used to form the core layer and/or skin layer, such material may be processed by sintering, reaction-sintering, or chemically vapor-deposited. Graphite polyimide may be used to form the laminated base connector that is provided with an inwardly-flared end section for adhesively attaching to the terminal edge portions of both the core layer and the skin layer by a high temperature adhesive typically consisting of a polyimide resin. The core layer may be impregnated with a dielectric filler, if desired.

These features and advantages of the present invention as well as others will be more fully understood when the following description is read in light of the accompanying drawings, in which.

Figure 1:
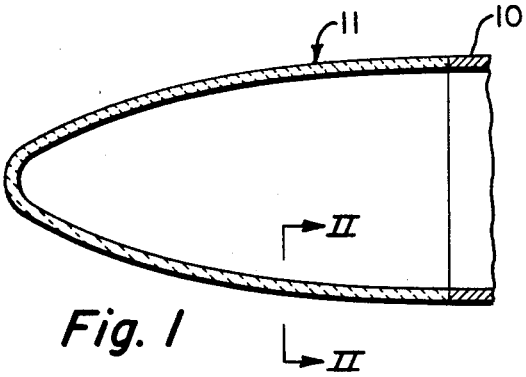
FIG. 1 is a transverse sectional view showing one typical configuration of a radome embodying the features of the present invention.
Figure 2:
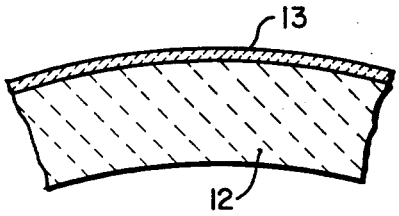
FIG. 2 is an enlarged sectional view taken along line II—II of FIG. 1.
Figure 3:
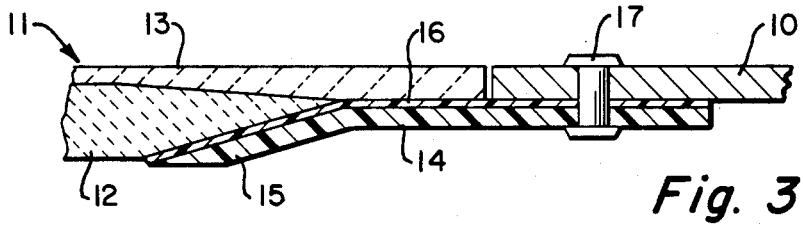
FIG. 3 is an enlarged sectional view showing an arrangement of parts for support of the radome apparatus of the present invention by the fuselage structure of an aircraft.

In FIGS. 1 and 3, there is illustrated the metallic fuselage skin 10 of an aircraft which defines an opening within which there is located a metallic reflector forming part of a radar antenna. The radar antenna is of any suitable well-known construction and is typically fed by a horn coupled to a waveguide to propagate electromagnetic wave energy toward the reflector and thence toward a radome 11. Electromagnetic wave energy is incident upon the airside surface of the radome as well as the inside surface thereof. The radome configuration may be generally as outlined in FIG. 1, although other configurations such as hemispheric or flat may be used to form an aperture seal for the opening in the fuselage skin of the aircraft. In accordance with the present invention, the radome 11 is made of ceramic materials and consists of, as shown in FIGS. 2 and 3, a low density ceramic core 12 and an overlying high density outer skin 13. The outer skin 13 forms the airside surface of the radome. The group of materials suitable for forming the ceramic core 12 and the ceramic skin 13 consists of silicon nitride and barium-aluminum silicate. When silicon nitride material is used, it is formed by processes such as sintering, reaction-sintering or chemically vapor-deposited. To achieve the broadband high temperature performance of the radome of the invention, the ceramic core is low density with a low dielectric constant of about 1.8 and a low loss tangent. The ceramic core has a moderately-low modulus of elasticity and a low thermal expansion coefficient. These properties remain unchanged with no significant variation at temperatures up to 1500° F. Typically, the ceramic core has a thickness of about 0.45 inch. The outer ceramic skin 13 has a high density and a moderate dielectric constant of, for example, 5.0. The skin has a low electrical loss tangent and a low thermal expansion coefficient. These properties remain substantially constant with no significant variation at temperatures up to about 1500° F. Typically, the thickness of the skin 13 is about 0.030 inch. The ceramic core 12 may include, if desired, an organic or inorganic dielectric filler.

As shown in FIG. 3, the present invention provides a connector 14 for a high temperature ceramic radome with matching thermal expansion properties. The connector takes the form of an annular ring with an inwardly-flared end portion 15 that is attached by a layer of high temperature adhesive 16 to the ceramic core 12. The layer of adhesive 16 continues along the outer surface of the connector where it adhesively joins a thickened portion of the skin layer 13 to the connector. The connector is, in turn, attached by fasteners 17 to the fuselage 10 of the aircraft. However, it is to be understood that other forms of attachment may be used to join the connector 14 to the fuselage of the aircraft. The connector is constructed from laminated high temperature-resistant composite material that defines a thermal expansion closely matching the thermal expansion of the high temperature ceramic radome and specifically, for example, the low thermal expansion of the core and outer skin 12 and 13, respectively, of radome 11. A suitable material for the formation of a connector is graphite/polyimide. The layer of high temperature adhesive 16 is preferably polyimide resin.

The thermal expansion characteristics of a high temperature ceramic radome is matched with a connector by proper selection of the graphite fiber material and crossplying angles of the selected material. The use of high temperature resin materials, such as polyimides, and the protection of the attachment from direct exposure to the external environment permit the use of the radome connector in higher temperature environments as compared with, for example, resin-treated glass fiber material. The thermal expansion characteristics of resin glass fiber material cannot be adequately or sufficiently matched with the low thermal expansion characteristics of a ceramic wall consisting of, for example, silicon nitride or barium-aluminum silicate. The thermal expansion coefficient of such fiberglass materials varies from about $10\times10$ in/in/°F. to $25\times10$ in/in/°F., depending on the fiber orientation and the laminated construction. The high temperature ceramic radome wall of the present invention will exhibit a much lower thermal expansion coefficient of, for example, in the range of $1\times10^{-6}$ in/in/°F. to $15\times10^{-6}$ in/in/°F., depending upon the particular ceramic material. As described hereinafter, silicon nitride material has a coefficient of thermal expansion of $1.7\times10^{-6}$ in/in/°F. In view of this, it will be apparent to one skilled in the art that resintreated glass fiber has limited practical application to only relatively low temperature applications.

While various wall thicknesses may be employed to form the skin layer 13 and core layer 12, typically, the ratio of 15:1 is suitable. By judicious selection of material thicknesses for the core and skin layers, it is possible to achieve high electrical transmission efficiency with a minimum boresight error and very little antenna pattern distortion over wide bandwidths and large antenna scan angles. The radome apparatus of the present invention has an enhanced ability to absorb thermal shocks and support large thermal gradients without high induced stresses. This is achieved through the use of the ceramic materials with low thermal expansion coefficient and a moderately-low modulus of elasticity which, together with the two-layered construction, accommodate strains induced by thermal gradients without excessive stress in either of the skin or the core. Such strains and stresses cannot be accommodated by refractory oxides and/or a three-layered radome construction as described hereinbefore. Thermal stresses in the coupling area formed by the connector are minimized by matching the thermal expansion of the connector to that of the ceramic body of the radome. While the specific design of the radome of the present invention discussed hereinabove includes providing the core with a dielectric constant of about 1.8 and a dielectric constant of the skin about 5.0 without significant variation at temperatures up to 1500° F., these properties can be varied over reasonably wide ranges by appropriate adjustments to the skin and core fabrication parameters. Rapid or high-speed heating, sometimes called "flash heating", is effectively accommodated by the radome material. Selection of the exact dielectric properties desired for a specific design is, of course, a function of the range of frequencies, the temperature environment, the radome shape, and the degree of optimization desired for specific frequencies within the broadband range of the radome.

The following Tables I and II show comparative chemical and physical properties of ceramic radome materials from the previously-identified U.S. Pat. No. 3,292,544 and the ceramic radome materials of the present invention:

TABLE I

| | Example of Prior Art Radome Materials | | | |
|---|---|---|---|---|
| | Alumina | | Mullite or Calcined Sillimanite | |
| | Core | Skin | Core | Skin |
| Tensile Strength psi | 500–1400 | 22,000 | 700 | 17,400 |
| Tensile Modulus $10^6$ psi | 0.2–0.6 | 40 | 0.3 | 31 |
| Compression Strength psi | 1100–8000 | 150,000 | 1000 | 72,000 |
| Compression Modulus $10^6$ psi | 0.2–0.6 | 40 | 0.3 | 31 |
| Density grams/cc | .74–1.34 | 3.66–3.71 | 1 | 3.1 |
| Coefficient of Thermal Expansion in/in/°F. | $4.5\times10^{-6}$ | $4.5\times10^{-6}$ | $3\times10^{-6}$ | $3\times10^{-6}$ |
| Dielectric Constant | 2–2.9 | 8–9 | 2.1 | 7 |
| Loss Tangent | .0005–.002 | .007 | .001 | .005 |
| Emissivity at 900° F. | 0.44 | 0.44 | Not Available | Not Available |

TABLE II

| | Radome Materials of the Present Invention | | | |
|---|---|---|---|---|
| | Silicon Nitride | | Barium-Aluminum Silicate | |
| | Core | Skin | Core | Skin |
| Tensile Strength psi | 1000 | 20,000 | 100 | 6000 |
| Tensile Modulus $10^6$ psi | 0.45 | 14 | 0.07 | 10 |
| Compression Strength psi | 1100 | 100,000 | 300 | 50,000 |
| Compression Modulus $10^6$ psi | 0.45 | 14 | 0.07 | 10 |
| Density grams/cc | 0.6 | 2.2 | 0.6 | 2.95 |
| Coefficient of Thermal Expansion in/in/°F. | $1.7\times10^{-6}$ | $1.7\times10^{-6}$ | $1.9\times10^{-6}$ | $1.9\times10^{-6}$ |
| Dielectric Constant | 1.8 | 5 | 1.5 | 5.9 |
| Loss Tangent | .005 | .005 | .0005 | .0005 |
| Emissivity at 900° F. | 0.5 | 0.5 | Not Available | Not Available |

The prior art refractory oxide materials have serious limitations to withstand a thermal gradient. The radome of the present invention has much greater thermal gradient capabilities. For example, the calculated gradient which will cause failure of the alumina material is about 250° F. and about 375° F. for the mullite or calcined sillimanite materials. By contrast, the silicon nitride and barium-aluminum silicate materials of the present invention have a calculated capability to withstand the gradient of about 1725° F. for silicon nitride and about 800° F. for barium-aluminum silicate. The prior art materials have a relatively high tensile modulus and, therefore, are more thermal sensitive. In other words, barium-aluminum silicate has twice the thermal gradient capability than mullite and silicon nitride has seven times greater thermal gradient capability than alumina.

Figure 4:
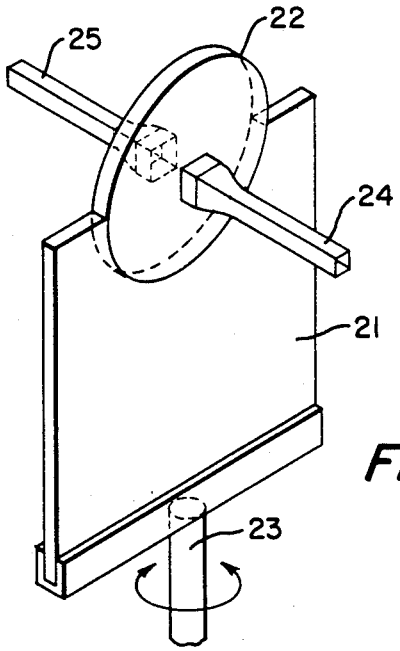
FIG. 4 is a schematic illustration of a test apparatus used for obtaining microwave transmission test data from a sample of a radome wall constructed according to the present invention.
Figure 5:
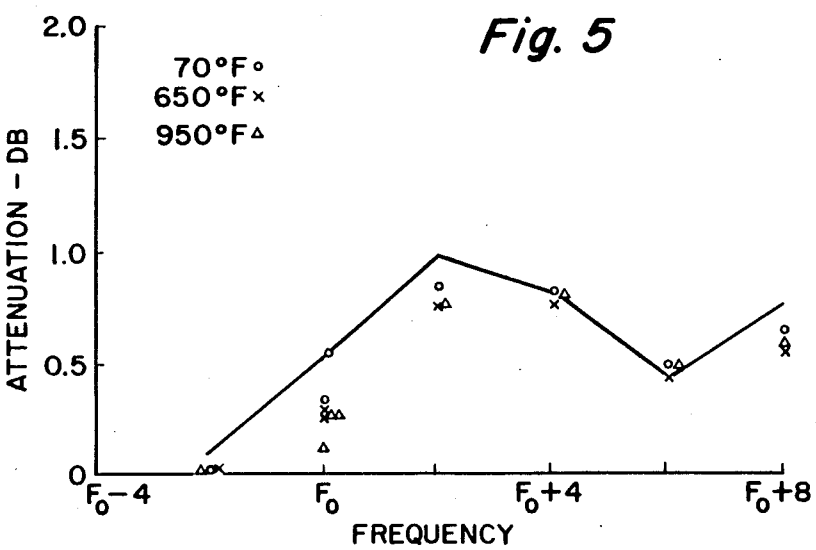
FIG. 5 is a graph showing attenuation versus frequency in a test using the apparatus of FIG. 4.

FIG. 4 illustrates the arrangement of test apparatus used for obtaining data as to the performance characteristics of a radome wall as illustrated in FIG. 2. The performance data is illustrated by the graphs of FIGS. 5–8. In FIG. 4, the test apparatus includes a holder 21 of dielectric material to support a 10-inch diameter flat test specimen 22 with a two-layered construction from silicon nitride according to the foregoing description and illustration by FIG. 2 of the present invention. The holder 21 is supported by an indexing column 23 arranged vertically and extends downwardly from the holder 21. Waveguides 24 and 25 extend horizontally toward opposite sides of the test specimen 22. The waveguides have flared ends forming feed horns to deliver and receive electromagnetic wave energy. In FIG. 5, the graph line represents a calculated transmission loss at elevated temperatures. The plot points shown as dots in the graph are measured points taken at 70° F. The plot points indicated by an X are measurements taken at 650° F. and finally, the plot points indicated by triangles are measurements taken at 950° F. The measurements of the transmission loss at these elevated temperatures were made using the apparatus shown in FIG. 4 while the test section of the radome was heated by thermal radiation from a remote source. The heat was applied onto the skin side with a time temperature profile which matched a specific requirement.

Figure 6:
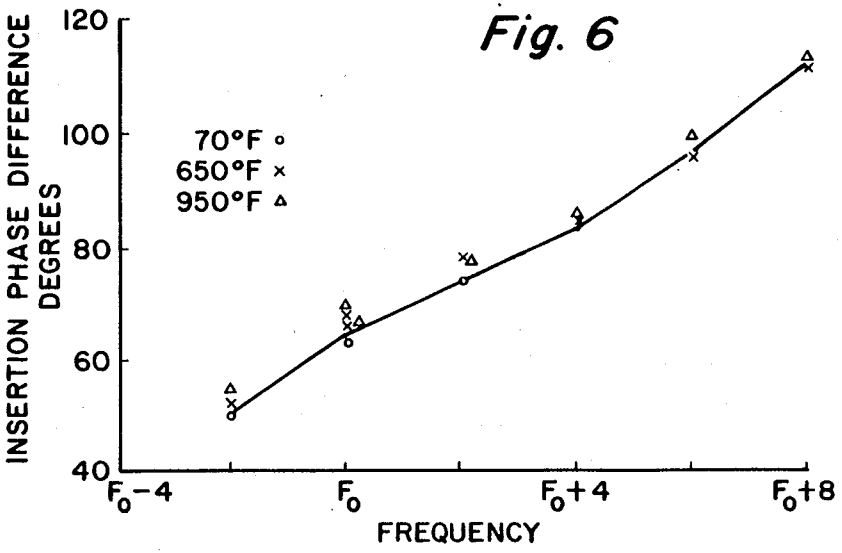
FIG. 6 is a graph showing insertion phase difference in degrees versus frequency using the test apparatus of FIG. 4.
Figure 8:
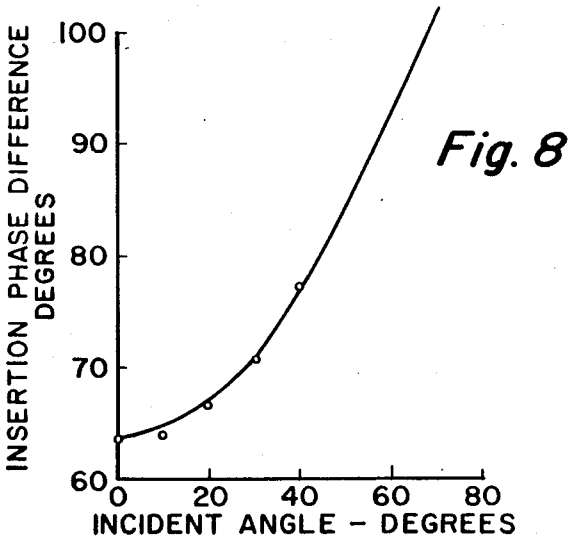
FIG. 8 is a graph illustrating the insertion phase difference in degrees versus incident angle in degrees using the test apparatus shown in FIG. 4.
Figure 7:
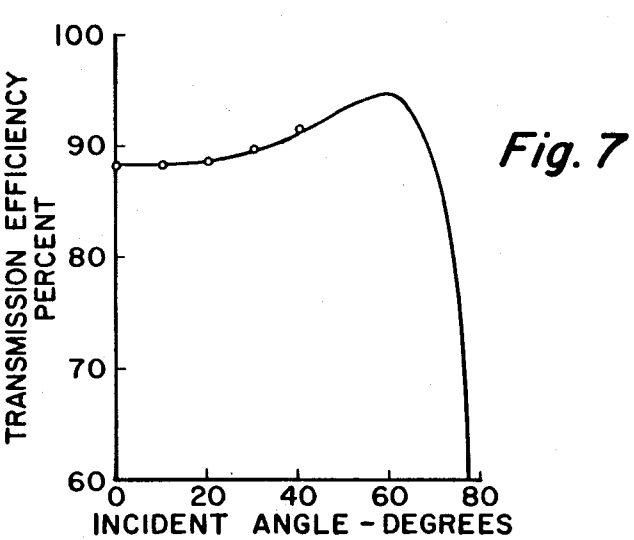
FIG. 7 is a graph showing transmission efficiency in percent versus incident angle using the test apparatus of FIG. 4.

In FIG. 6, the graph line represents a calculated insertion phase difference at elevated temperatures. The plot points given by the dot, X and triangle represent the same elevated temperature described previously in regard to FIG. 5. In FIG. 6, the insertion phase difference was measured with normal incidence of the electromagnetic wave energy on the test specimen. In the graphs of FIGS. 5 and 6, the tests were carried out over a very broad bandwidth, in excess of 4 octaves, from the design frequency $f_o$. In FIGS. 7 and 8, the transmission characteristics and incident angle variations were measured using perpendicular polarization at the design frequency $f_o$. The measurements were taken through the various incident angles by a yawing control to move the dielectric holder relative to the antennas provided by the waveguides. In FIG. 7, the graph line shows calculated transmission efficiency at various incident angles while the plot points are actual measurements. The graph line shows good transmission efficiency up to at least an incident angle of 70°. In FIG. 8, the graph line is calculated with test data indicated by the test points.

Figure 9:
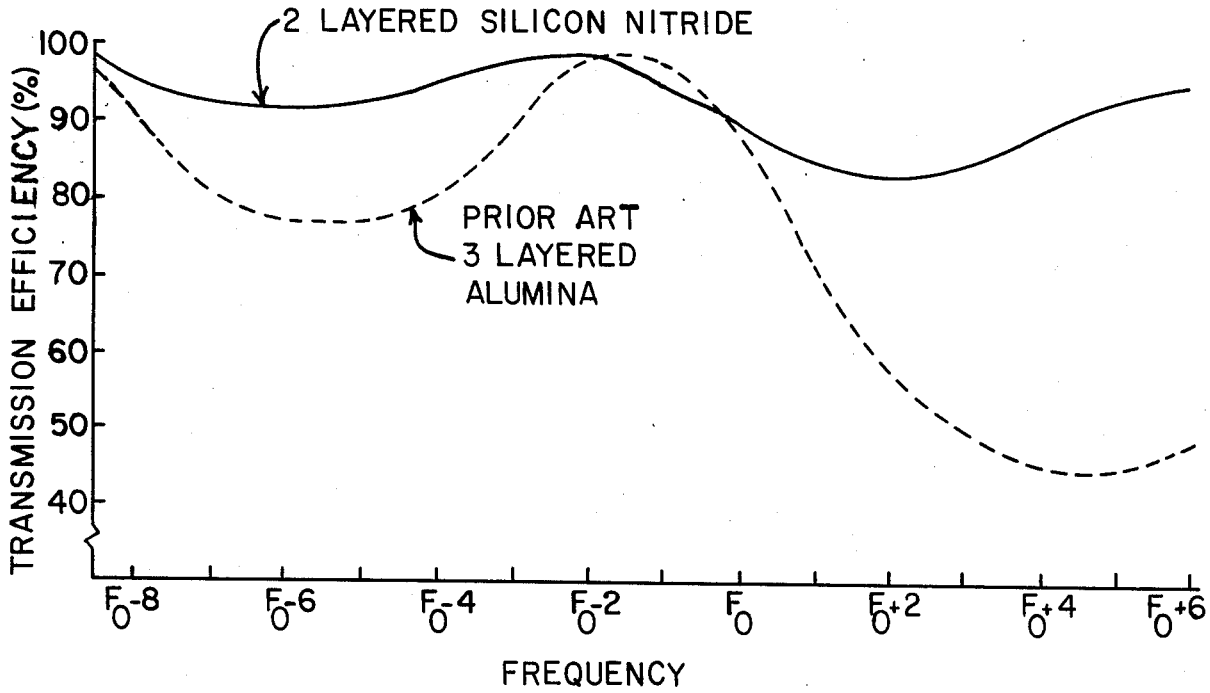
FIG. 9 is a graph illustrating an electrical performance comparison of a prior art ceramic radome wall with the two-layered radome wall of the present invention.
Figure 10:
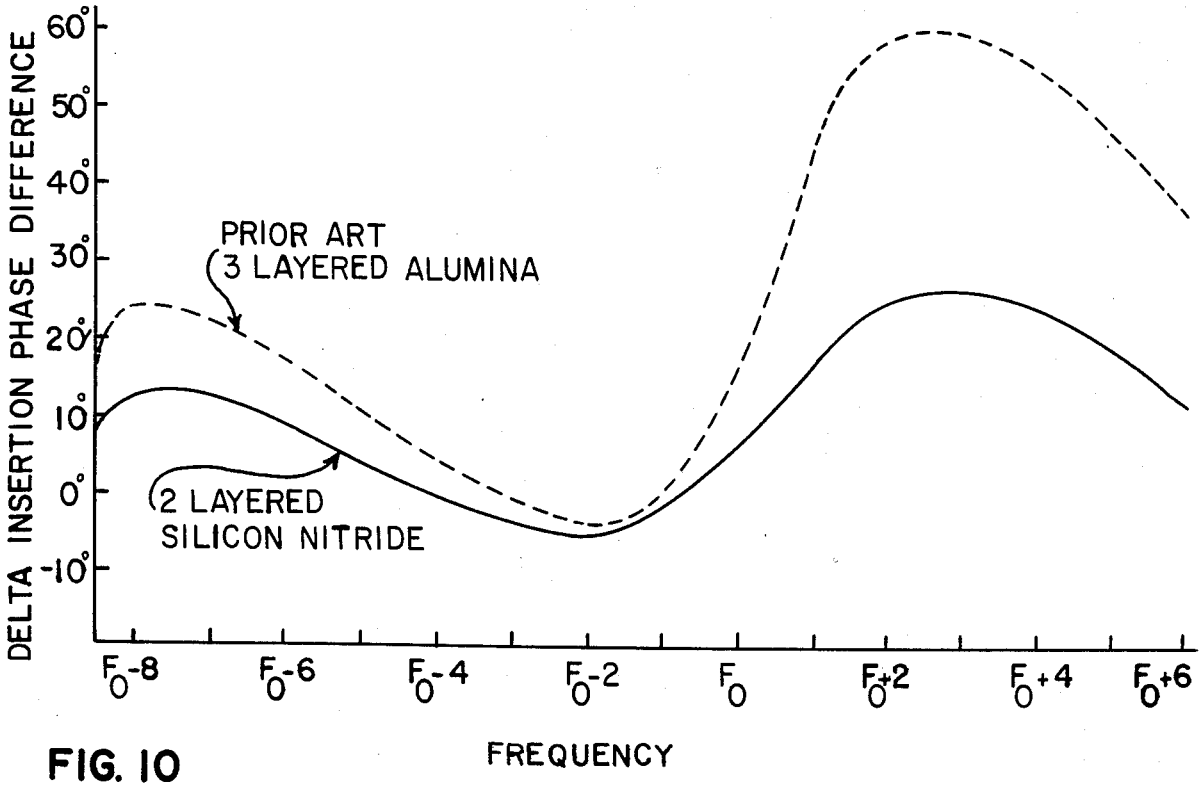
FIG. 10 is a graph illustrating a comparison of insertion phase difference for the same prior art ceramic radome wall and the two-layered radome of the present invention.

The graphs of FIGS. 9 and 10 show the transmission efficiency and delta-insertion phase difference over a broadband for one construction and material of a prior art radome and the unique two-layered construction and material for the radome of the present invention. The solid graph lines in FIGS. 9 and 10 depict the electrical performance for a radome wall consisting of two layers of silicon nitride. The skin thickness is 0.025 inch with a dielectric constant of 5.0 and a loss tangent of 0.002. The core layer has a thickness of 0.47 inch, a dielectric constant of 1.8 and a loss tangent of 0.002. The broken graph lines in FIGS. 9 and 10 represent electrical performance of a prior art radome made of alumina with a three-layered construction of which the outer and inner skin layers each having a thickness of 0.025 inch, a dielectric constant of 8.0 and a loss tangent of 0.002. The core layer has a thickness of 0.25 inch, a dielectric constant of 2.5 and a loss tangent of 0.002. The plot points for the graph lines of FIGS. 9 and 10 were developed for normal incidence over a frequency band at the design frequency $f_o$ from $f_o-9$ to $F_0$30 6. The two-layered silicon nitride radome wall has a greater transmission efficiency over the broadband that is consistently higher as compared with the three-layered alumina radome wall of the prior art. The comparative performance graph lines in FIG. 9 must be considered in view of a perfect transmission efficiency which is a straight line at 100% over the frequencies of the broadband. The graph of FIG. 10 demonstrates the maximum insertion phase difference between perpendicular and parallel polarization in the 0°–70° incident angle range. The delta-inseration phase difference is consistently lower for the radome wall of the present invention as compared with the three-layered alumina radome wall of the prior art. Moreover, the angular change to the delta-insertion phase difference is far less for the unique combination of the silicon nitride two-layered construction of a radome wall than the three-layered alumina construction of the prior art. Over the frequencies of the broadband, a straight line at 0° will represent a perfect delta-insertion phase difference, i.e., no phase difference.

In view of the foregoing, it will be seen that the radome provides broadband uses over very broad frequency bands spanning several octaves within the ultra-high and superhigh frequency bands. The radome has potential application in a millimeter band over somewhat more restricted bandwidth ranges. By impregnating the core layer with organic or inorganic dielectric materials, accommodation is provided for usual design environments such as high humidity, high pressures, internal erosion, chemical exposure, laser attack and the like. These features are achieved without loss of the essential characteristics of the radome according to the present invention. The test results show excellent performance, repeatability and agreement with predicted values.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A two-layered broadband high temperature radome resistant to bending stresses induced by thermal gradients, said radome comprising a low density core layer and a high density outer skin layer each of said layers consisting of ceramic material selected from the group consisting of silicon nitride and barium-aluminum silicate.

2. The radome according to claim 1 wherein the thickness of said core layer to the thickness of said skin layer is given by the ratio of about 15:1.

3. The radome according to claim 1 wherein the thickness of said skin layer is 0.030 inch.

4. The radome according to claim 1 wherein said core layer defines a dielectric constant of about 1.8 and a low electrical loss tangent.

5. The radome according to claim 1 wherein said skin layer defines a dielectric constant of about 5.0 and a low electrical loss tangent.

6. The radome according to claim 1 wherein said silicon nitride is sintered.

7. The radome according to claim 1 wherein said silicon nitride is reaction-sintered silicon nitride.

8. The radome according to claim 1 wherein said skin layer is chemically vapor-deposited.

9. The radome according to claim 1 wherein said core layer includes a dielectric filler.

10. The radome according to claim 1 further comprising a base connector adhered to said core layer by high temperature adhesive.

11. The radome according to claim 10 wherein said base connector consists of graphite/polyimide.

12. The radome according to claim 10 wherein said base connector includes an inwardly-flared end section secured by said adhesive to the terminal edge portions of said core layer and said skin layer.

13. The radome according to claim 10 wherein said high temperature adhesive consists of polyimide resin.

14. A base connector for a high temperature ceramic radome, said base connector consisting of graphite/-polyimide with a coefficient of thermal expansion closely matching the coefficient of thermal expansion of the ceramic radome.

15. The base connector according to claim 14 wherein said coefficient of thermal expansion of said base connector equals about $1.7\times10^{-6}$ in/in/°F.

* * * * *